US008424422B2

(12) United States Patent
Liang

(10) Patent No.: US 8,424,422 B2
(45) Date of Patent: Apr. 23, 2013

(54) ADJUSTABLE SOCKET STRUCTURE

(76) Inventor: Yi-Ming Liang, Taichung (TW)

( * ) Notice: Subject to any disclaimer, the term of this patent is extended or adjusted under 35 U.S.C. 154(b) by 219 days.

(21) Appl. No.: 13/150,855

(22) Filed: Jun. 1, 2011

(65) Prior Publication Data

US 2012/0304834 A1 Dec. 6, 2012

(51) Int. Cl.
*B25B 13/20* (2006.01)

(52) U.S. Cl.
USPC ..... 81/128; 81/129

(58) Field of Classification Search ..... 81/128, 81/129, 125
See application file for complete search history.

(56) References Cited

U.S. PATENT DOCUMENTS 2,884,826 A * 5/1959 Bruhn ..... 81/128
5,819,607 A * 10/1998 Carnesi ..... 81/128
6,622,598 B2 * 9/2003 Chang ..... 81/128
7,946,200 B2 * 5/2011 Chang ..... 81/128

* cited by examiner

*Primary Examiner* — David B Thomas

(57) ABSTRACT

An adjustable socket structure contains a body including a first groove, a second groove, a first notch, a number of slots; a plurality of paws, each including a sliding block, and the sliding block including a first hole; a number of connecting rods, each being movably fixed in the second groove and including a first axial shank and a second axial shank; a driving shaft including an axial portion and a disk portion, wherein the axial portion includes a square bore, and the disk portion is rotated in the first groove and includes an outer diameter larger that the axial portion and three second holes so that the driving shaft is rotated to actuate the paws to move in the slots respectively by using the connecting rods; a helical retaining ring retained in the first notch to abut against a rear end of the disk portion of the driving shaft.

10 Claims, 7 Drawing Sheets

ADJUSTABLE SOCKET STRUCTURE

BACKGROUND OF THE INVENTION

1. Field of the Invention

The present invention relates to an adjustable socket structure that is capable of simplifying related components and assembling process.

2. Description of the Prior Art

A conventional adjustable socket structure disclosed in U.S. Pat. No. 6,622,598 contains a sleeve head, a sleeve body, and a set of pawls. The sleeve head is coupled on the bottom with the sleeve body, and both of them can rotate freely. The sleeve body has multiple slide rails distributed on its inner wall evenly The pawls slide in these slide rails, and the shafts on the top of these pawls extrude to the space designed between the sleeve head and the sleeve body. Connected to the shafts are corresponding connecting rods, which have corresponding pins fixed onto the sleeve head. When the sleeve head rotates, it drives the pawls through the connecting rods to open/close simultaneously. In this way, when the operator turns the sleeve barrel clockwise/anti-clockwise, the pawls will screw a nut down/up together, which is convenient and practical.

However, such a conventional socket structure is not strong enough to rotate a screwing element with a large torque.

Likewise, the conventional socket structure is complicated without being assembled easily.

In addition, when operating the conventional socket, a noise makes because the retaining ring 30 and a shoulder 210 crashes easily.

The present invention has arisen to mitigate and/or obviate the afore-described disadvantages.

SUMMARY OF THE INVENTION

The primary object of the present invention is to provide an adjustable socket structure that is capable of simplifying related components and assembling process.

Further object of the present invention is to provide an adjustable socket structure in which the disk portion is prevented from crashing other components to achieve a noise proof purpose.

Another Further object of the present invention is to provide an adjustable socket structure that is capable of obtaining a strong structure An adjustable socket structure provided by the present invention contains:

a body including a first groove disposed on a rear surface thereof, a second groove with a smaller diameter fixed on a bottom end of the first groove, a first notch formed on the first groove, a number of slots radially arranged on a front end of the body and communicating with the second groove;

a plurality of paws, each including a sliding block to be movably retained in the slot, and the sliding block including a first hole formed on a rear side thereof;

a number of connecting rods, each being movably fixed in the second groove and including a first axial shank disposed on one side thereof to be rotably inserted in the first hole and a second axial shank fixed on another side thereof;

a driving shaft including an axial portion and a disk portion located at a front end of the axial portion, wherein the axial portion includes a square bore, and the disk portion is rotated in the first groove and includes an outer diameter which is larger that the axial portion and three second holes to insert the second axial shanks of the connecting rods so that the driving shaft is rotated to actuate the paws to move in the slots respectively by using the connecting rods;

a retaining ring being helical and retained in the first notch to abut against a rear end of the disk portion of the driving shaft.

DETAILED DESCRIPTION OF THE PREFERRED EMBODIMENTS

Figure 1:
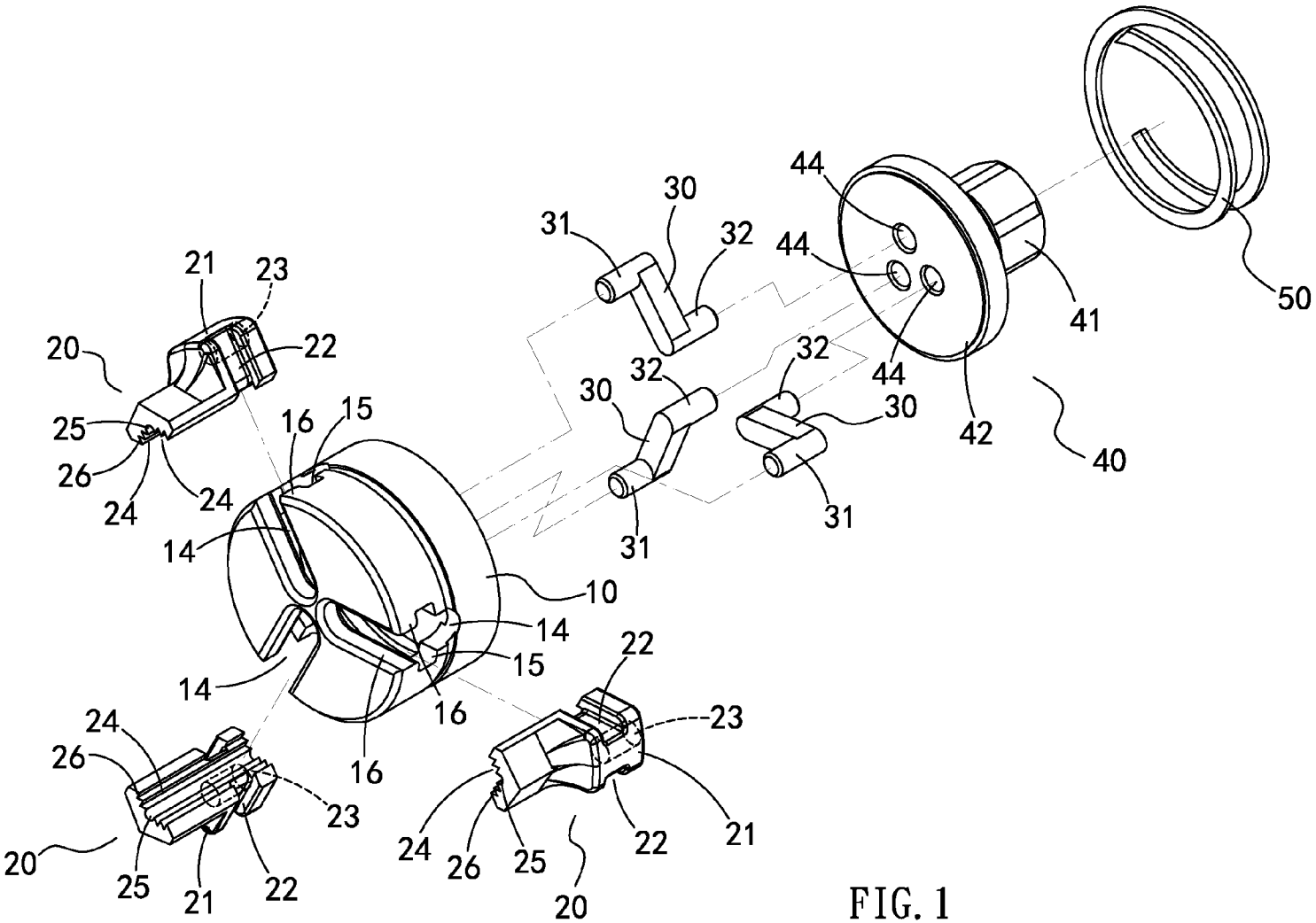
FIG. 1 is a perspective view showing the exploded components of an adjustable socket structure in accordance with a preferred embodiment of the present invention.
Figure 2:
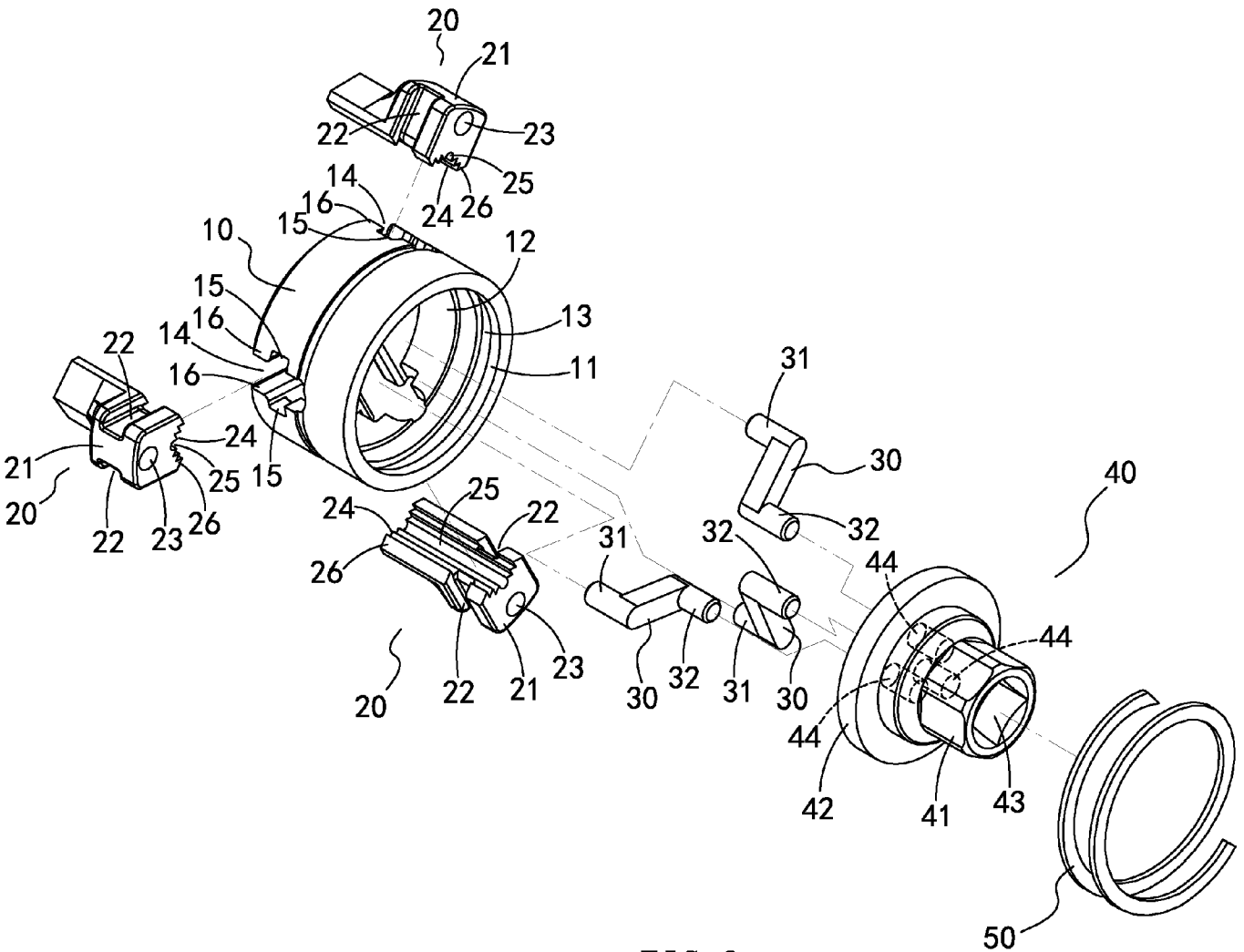
FIG. 2 is another perspective view showing the exploded components of then adjustable socket structure in accordance with the preferred embodiment of the present invention.
Figure 3:
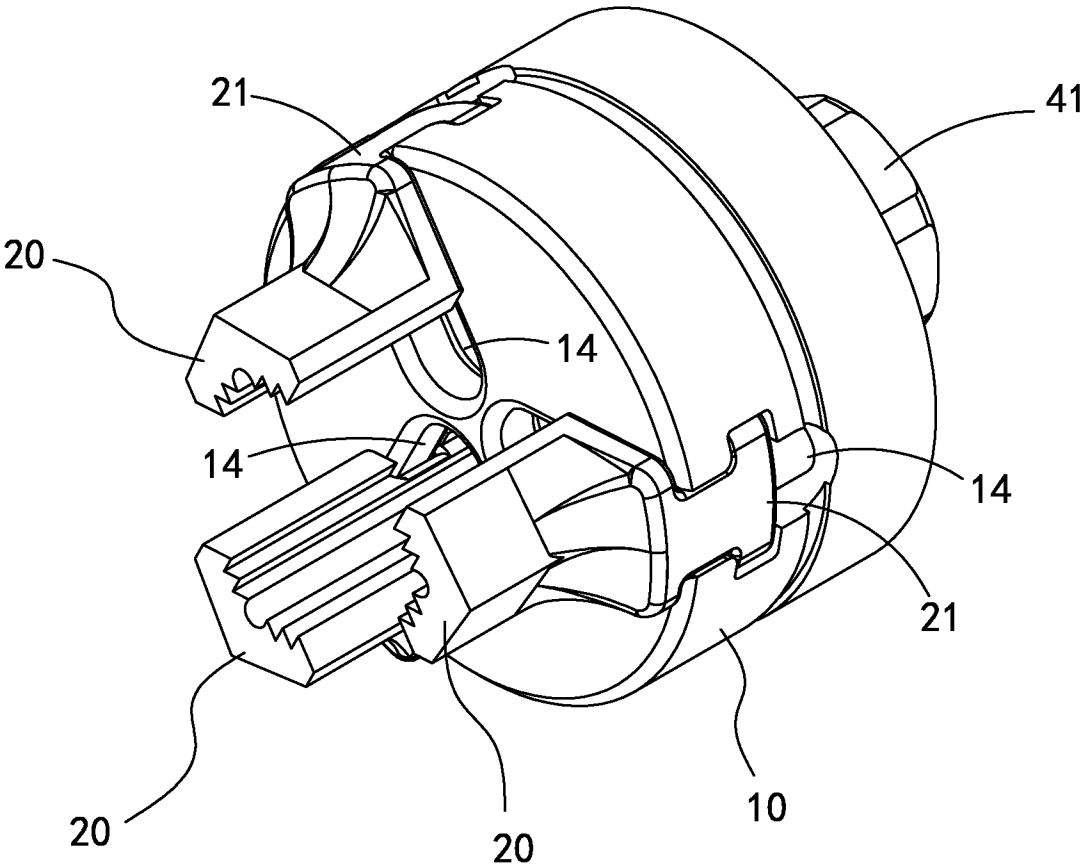
FIG. 3 is a perspective view showing the assembly of the adjustable socket structure in accordance with the preferred embodiment of the present invention.
Figure 4:
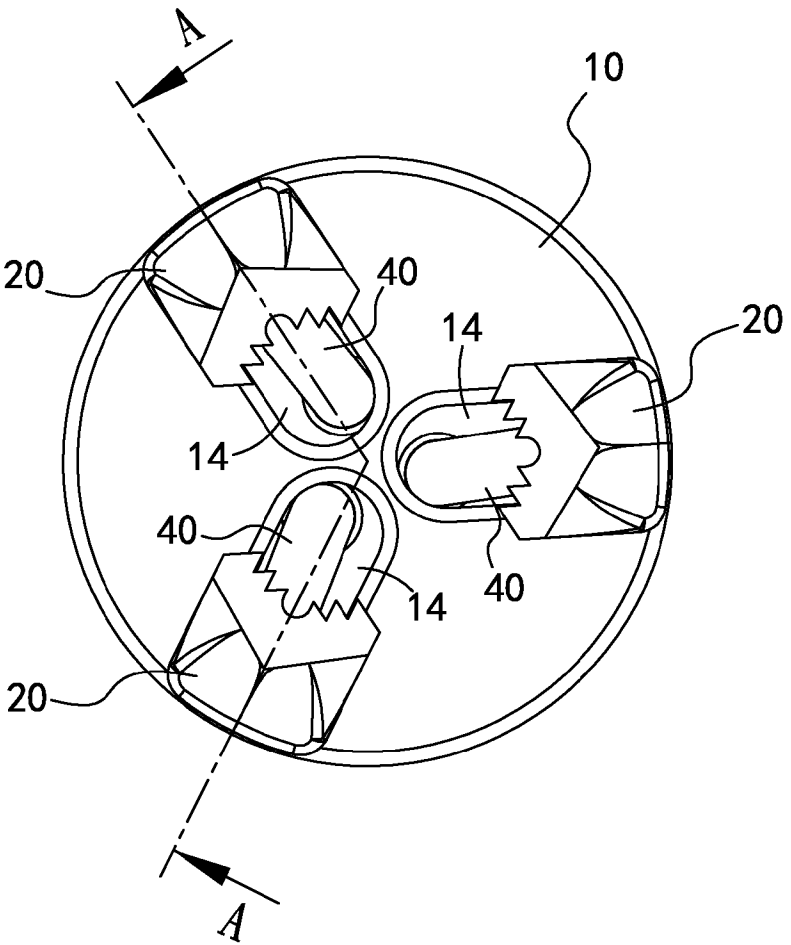
FIG. 4 is a front side plan view showing the assembly of the adjustable socket structure in accordance with the preferred embodiment of the present invention.

The present invention will be clearer from the following description when viewed together with the accompanying drawings, which show, for purpose of illustrations only, the preferred embodiment in accordance with the present invention.

As shown in FIG. 1-5, an adjustable socket structure according to a preferred embodiment of the present invention comprises a body 10, three paws 20, three connecting rods 30, a driving shaft 40, and a retaining ring 50.

The body 10 is formed in a cylinder shape and includes a first groove 11 disposed on a rear surface thereof, a second groove 12 with a smaller diameter fixed on a bottom end of the first groove 11, and a first notch 13 formed on the first groove 11. The body 10 includes three slots 14 radially arranged on a front end of the body 10 and communicating with the second groove 12, each slot 14 includes two recesses 15 secured on two walls thereof respectively and two ribs 16 fixed on two front ends of the recesses 15 individually.

Figure 9:
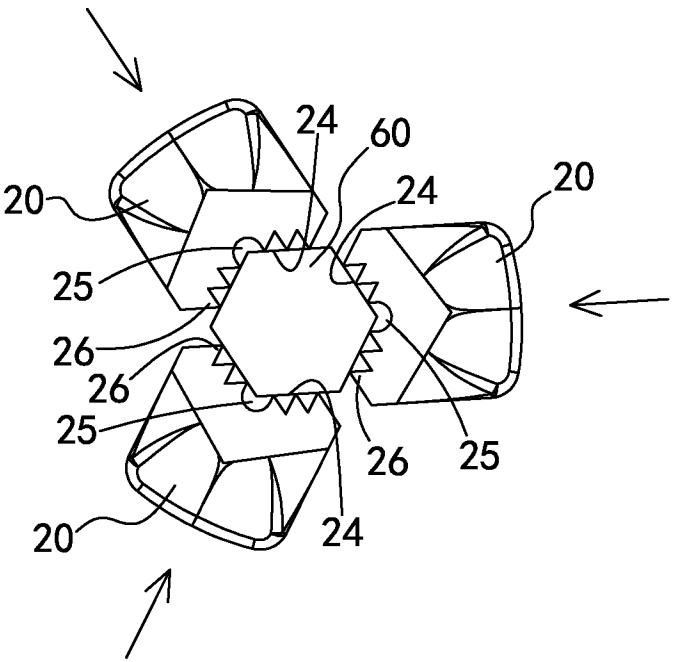
FIG. 9 is another plan view showing the operation of the adjustable socket structure in accordance with the preferred embodiment of the present invention.

Each paw 20 includes a sliding block 21 to be movably retained in the slot 14, and the sliding block 21 includes two second notches 22 secured on two sides thereof respectively to retain the two ribs 16, a first hole 23 formed on a rear side thereof, a V-shaped locking face 24 to retain with a screwing element 60, and the screwing element 60 is a nut or a screw bolt; the paw 20 also includes an arcuate cutout 25 formed on a bottom end of the locking face 24, and a plurality of teeth 26 arranged on the locking face 24 to engage with various screwing elements 60 as illustrated in FIG. 9.

Each connecting rod 30 is movably fixed in the second groove 12 and includes a first axial shank 31 disposed on one side thereof to be rotably inserted in the first hole 23 and a second axial shank 32 fixed on another side thereof.

The driving shaft 40 includes an axial portion 41 and a disk portion 42 located at a front end of the axial portion 41, wherein the axial portion 41 is formed in a polygonal column shape (such as a hexagon column) to fit with a wrench and includes a square bore 43 to retain a wrench or a coupling extension. The disk portion 42 is circular to be rotated in the first groove 11 and includes an outer diameter which is larger that the axial portion 41, three second hole 44 used to insert the second axial shanks 32 of the three connecting rods 30 so that the driving shaft 40 is rotated to actuate the three paws 20 to move in the slots 14 respectively by using the three connecting rods 30, thus engaging or disengaging the screwing element 60 as shown in FIGS. 7 and 9.

The retaining ring 50 is helical and retained in the first notch 13 to abut against a rear end of the disk portion 42 of the driving shaft 40 so that the disk portion 42 is limited in the first groove 11.

Figure 6:
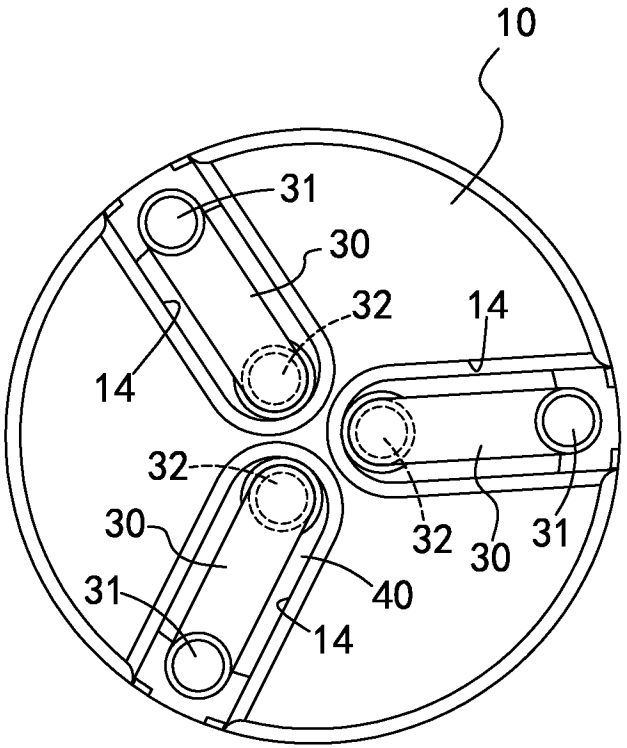
FIG. 6 is a plan view showing the operation of the adjustable socket structure in accordance with the preferred embodiment of the present invention.
Figure 7:
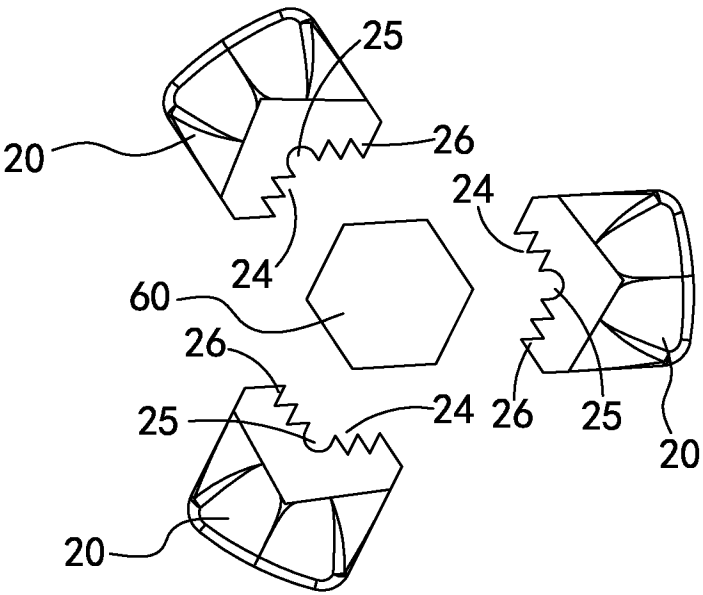
FIG. 7 is another plan view showing the operation of the adjustable socket structure in accordance with the preferred embodiment of the present invention.

Referring to FIGS. 6 and 7, when the three second axial shanks 32 are located at central positions thereof individually (i.e., when the connecting rods 30 align with the three slots 14), the three paws 20 expends toward a largest range to be retained with the screwing element 60.

Figure 5:
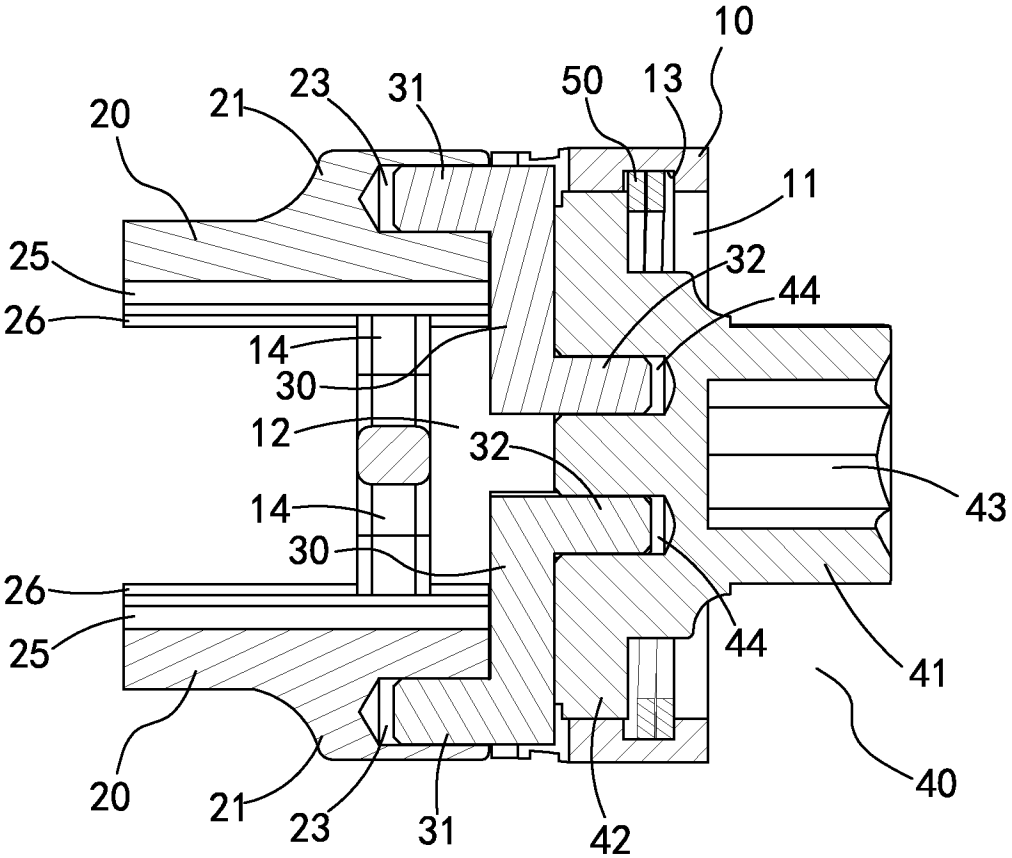
FIG. 5 is a cross sectional view taken along the line A-A of FIG. 4.
Figure 8:
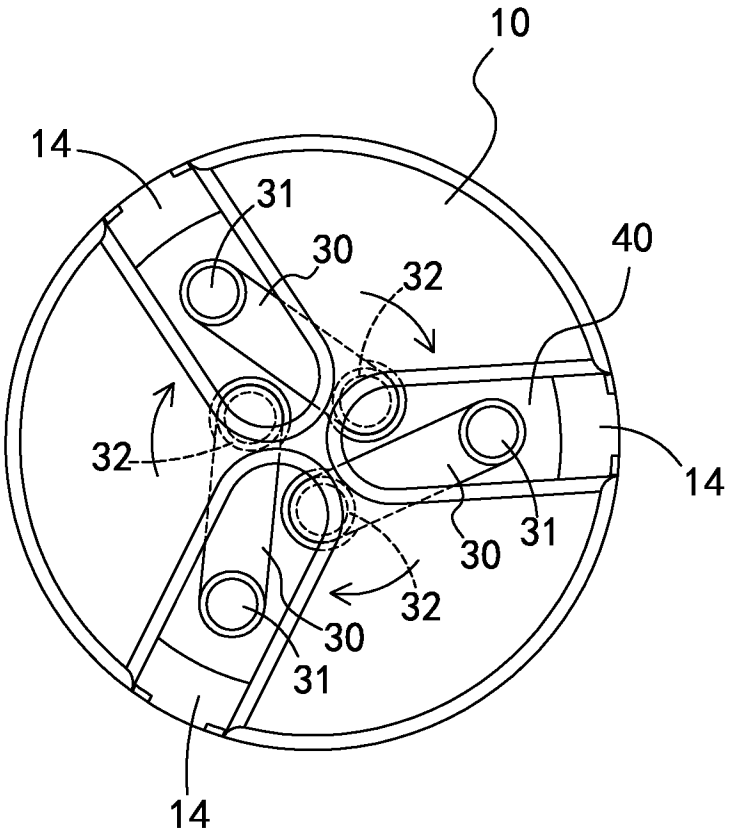
FIG. 8 is also another plan view showing the operation of the adjustable socket structure in accordance with the preferred embodiment of the present invention.

As shown in FIGS. 5, 8, 9, in operation, the driving shaft 40 is rotated in a clockwise direction, and the second axial shanks 32 are actuated by the disk portion 42 of the driving shaft 40 in the clockwise direction so that the connecting rods 30 actuate the paws 20 to move in the slots 14, hence the retaining faces 24 engage with the screwing element 60. Thereafter, the wrench is rotated in the clockwise direction as well to actuate the driving shaft 40, and then the paws 20 retain the screwing element 60 and actuate the screwing element 60 to rotate in the clockwise direction.

When the driving shaft 40 is rotated in an anti-clockwise direction, the second axial shanks 32 move back to the central positions of three slots 14 so that the connecting rods 30 actuate the paws 20 to expand, thus releasing the screwing element 60. Thereafter, the driving shaft 40 is rotated to further turn the axial shanks 32 in the anti-clockwise direction so that the connecting rods 30 actuate the paws 20 to move in the slots 14, hence the locking faces 20 retain the screwing element 60. Thereby, the wrench is capable of rotating the driving shaft 40 in the anti-clockwise direction, and the paws 20 retain the screwing element 60 and actuate the screwing element 60 to rotate in the anti-clockwise direction.

It is to be noted that inner ends of the slots 14 do not communicate with one another, therefore sectors formed between the slots 14 communicate with the central positions of the slots 14 to obtain a strong structure. Besides, the first axial shank 31 and the second axial shank 32 are connected with the paws 20 and the driving shaft 40 to simplify related components and assembling process.

Furthermore, the retaining ring 50 is biased against the disk portion 42 of the driving shaft 40 so that the disk portion 42 axially rotates in the first groove 42 without axially moving so that the disk portion 42 is prevented from crashing other components to achieve a noise proof purpose.

Numbers of the paws 20 and the connecting rods 30 are not limited to three, i.e., at least two paws 20 and connecting rods 30 are allowable.

While we have shown and described various embodiments in accordance with the present invention, it is clear to those skilled in the art that further embodiments may be made without departing from the scope of the present invention.

What is claimed is:

1. An adjustable socket structure comprising:

a body including a first groove disposed on a rear surface thereof, a second groove with a smaller diameter fixed on a bottom end of the first groove, a first notch formed on the first groove, a number of slots radially arranged on a front end of the body and communicating with the second groove;

a plurality of paws, each including a sliding block to be movably retained in the slot, and the sliding block including a first hole formed on a rear side thereof;

a number of connecting rods, each being movably fixed in the second groove and including a first axial shank disposed on one side thereof to be rotably inserted in the first hole and a second axial shank fixed on another side thereof;

a driving shaft including an axial portion and a disk portion located at a front end of the axial portion, wherein the axial portion includes a square bore, and the disk portion is rotated in the first groove and includes an outer diameter which is larger that the axial portion and three second holes to insert the second axial shanks of the connecting rods so that the driving shaft is rotated to actuate the paws to move in the slots respectively by using the connecting rods;

a retaining ring being helical and retained in the first notch to abut against a rear end of the disk portion of the driving shaft.

2. The adjustable socket structure as claimed in claim 1, wherein each slot includes two recesses secured on two walls thereof respectively and two ribs fixed on two front ends of the recesses individually, the sliding block includes two second notches secured on two sides thereof respectively to retain the two ribs.

3. The adjustable socket structure as claimed in claim 2, wherein the axial portion of the driving shaft is formed in a polygonal column shape to fit with a wrench.

4. The adjustable socket structure as claimed in claim 3, wherein each paw includes a V-shaped locking face to retain with a screwing element.

5. The adjustable socket structure as claimed in claim 4, wherein the paw includes a plurality of teeth arranged on the locking face.

6. The adjustable socket structure as claimed in claim 5, wherein the paw also includes an arcuate cutout formed on a bottom end of the locking face.

7. The adjustable socket structure as claimed in claim 1, wherein the axial portion of the driving shaft is formed in a polygonal column shape to fit with a wrench.

8. The adjustable socket structure as claimed in claim 7, wherein each paw includes a V-shaped locking face to retain with a screwing element.

9. The adjustable socket structure as claimed in claim 8, wherein the paw includes a plurality of teeth arranged on the locking face.

10. The adjustable socket structure as claimed in claim 9, wherein the paw also includes an arcuate cutout formed on a bottom end of the locking face.

* * * * *